United States Patent [19]

Wuthrich

[11] 4,174,607

[45] Nov. 20, 1979

[54] MECHANISM FOR SELF-WIND WATCHES

[75] Inventor: Paul Wuthrich, Watertown, Conn.

[73] Assignee: Timex Corporation, Waterbury, Conn.

[21] Appl. No.: 968,956

[22] Filed: Dec. 13, 1978

[51] Int. Cl.[2] ..... G04B 5/02; G04B 7/02

[52] U.S. Cl. ..... 58/82 A; 58/46 R

[58] Field of Search ..... 58/7, 40, 41 R, 41 A, 58/41 B, 46 R, 46 W, 52 A, 80, 82 R, 82 A, 83 R, 59, 104

[56] References Cited

U.S. PATENT DOCUMENTS 2,928,231 3/1960 Murrie ..... 58/82 A

FOREIGN PATENT DOCUMENTS 335163 12/1958 Switzerland ..... 58/82 A

*Primary Examiner*—Edith S. Jackmon

*Attorney, Agent, or Firm*—William C. Crutcher

[57] ABSTRACT

In an automatic winding mechanism for a wristwatch, the motion of the oscillating off-center rotor is transmitted to a ratchet wheel which drives a planetary reduction gear winding the mainspring, by means of an improved single piece rocking arm. The rocking arm is made from a single stamping and includes spring loaded pawls, tabs to support it in place, and a spring clip retaining the off-center rotor in its bushing.

7 Claims, 5 Drawing Figures

MECHANISM FOR SELF-WIND WATCHES

BACKGROUND OF THE INVENTION

This invention relates to a mechanism for automatically winding a wristwatch from motion of the wearer's wrist, and more particularly to an improved motion conversion device for the mechanism.

Automatic or "self-winding"wristwatches, in which the mainspring is wound by the movement of an off-center weight on a rotor, need a motion conversion device to convert the to-and-fro rotor motion into a unidirectional rotary motion to wind the mainspring. The self-wind mechanism also needs reduction gearing to multiply the force of the weak repetitive movements of the rotor into sufficient force to wind the main spring.

Various types of devices for converting oscillating rotor motion to unidirectional rotary motion have been employed in the prior art. These tend to be complicated and delicate, as well as difficult to assemble in view of the small size of the parts.

An example of an automatic winding mechanism for a watch is seen in U.S. Pat No. 3,104,517 issued Sept. 24, 1963 to the applicant and assigned to the aplicant's assignee, which is fully incorporated herein by reference. In this patent, the motion conversion device comprises a heart-shaped cam and spring loaded pawls pivotably mounted on a lever which cooperate to actuate a ratchet wheel. The ractchet wheel winds the mainspring barrel through planetary reduction gears.

Another type of motion conversion device is seen in U.S. Pat. No. 2,696,073 issued to G. Langel on Dec. 7, 1954, in which an eccentric crank portion on the oscillating rotor staff imparts rectilinear motion to a spring loaded double hairpin ratchet spring driving the ratchet wheel. Both the aforementioned U.S. Pat. Nos. 3,104,517 and 2,696,073 require several parts and are difficult to assemble.

Other patents illustrative of automatic winding devices for wristwatches are U.S. Pat. No. 2,928,231 issued Mar. 15, 1960 to Murrle; U.S. Pat. No. 2,645,894 issued July 21, 1953 to Huguenin; U.S. Pat No. 2,744,413 issued May 8, 1956 to Schneider; U.S. Pat. No. 2,807,133 issued Sept. 24, 1957 to Maire; U.S. Pat. No. 2,874,532 issued Feb. 24, 1959 to Baier; and U.S. Pat. No. 2,942,486 issued June 28, 1960 to Beguin.

It would be desirable to have an automatic winding mechanism for wristwatches which would permit easy access to the self-winding mechanism, easy removal of the rotor and associated parts for servicing, and easy reassembly without need for adjustment. Further, since the rotor is actuated by motion of the wearer's arm, it must be rugged and resistant to sudden shocks.

Accordingly, one object of the present invention is to provide an improved automatic winding mechanism for wristwatches which employs a minimum of parts and is easy to assemble.

Another object of the invention is to provide an improved device for converting oscillating motion of the rotor in a self-winding watch to unidirectional rotation of the winding pinion, using an improved rocking arm.

DRAWINGS

The invention, both as to organization and method of pratice, together with further objects and advantages thereof, will best be understood by reference to the following description, taken in connection with the accompanying drawings, in which:

FIG. 1 is an elevation drawing, partly in section of an automatic winding mechanism for a wristwatch, omitting the conventional portions of the watch, FIG. 2 is a plan view of the main operative components of the self-wind mechanism illustrating the operation of the motion converstion device, FIG. 3 is a plan view of the improved rocking arm, and FIGS. 4 and 5 are elevation views of portions of the rocking arm taken from the directions of lines IV—IV and V—V respectively in FIG. 3.

SUMMARY OF THE INVENTION

Briefly stated, the invention is an improvement in a watch of the type having a mainspring driving a time gear train, and having reduction gearing for periodically winding the mainspring by unidirectional rotation of a winding pinion, the improvement comprising a ratchet wheel connected to drive the pinion, a rotor bushing, a rotor staff having an eccentric crank portion disposed in the bushing, a rotor with an off-center mass connected to the rotor staff, and a single piece rocking arm with first and second spring loaded click arms engaging the ratchet wheel and a spring clip engaging the crank portion of the rotor staff and adapted to retain the rotor shaft within the bushing. The rocking arm is made from a single stamping with click arms arranged to provide spring loading of the ratchet wheel, tabs to hold the rocking arm in place and spring clip fingers inserted through a slot in the rotor bushing.

DESCRIPTION OF THE PREFERRED EMBODIMENT

Figure 1:
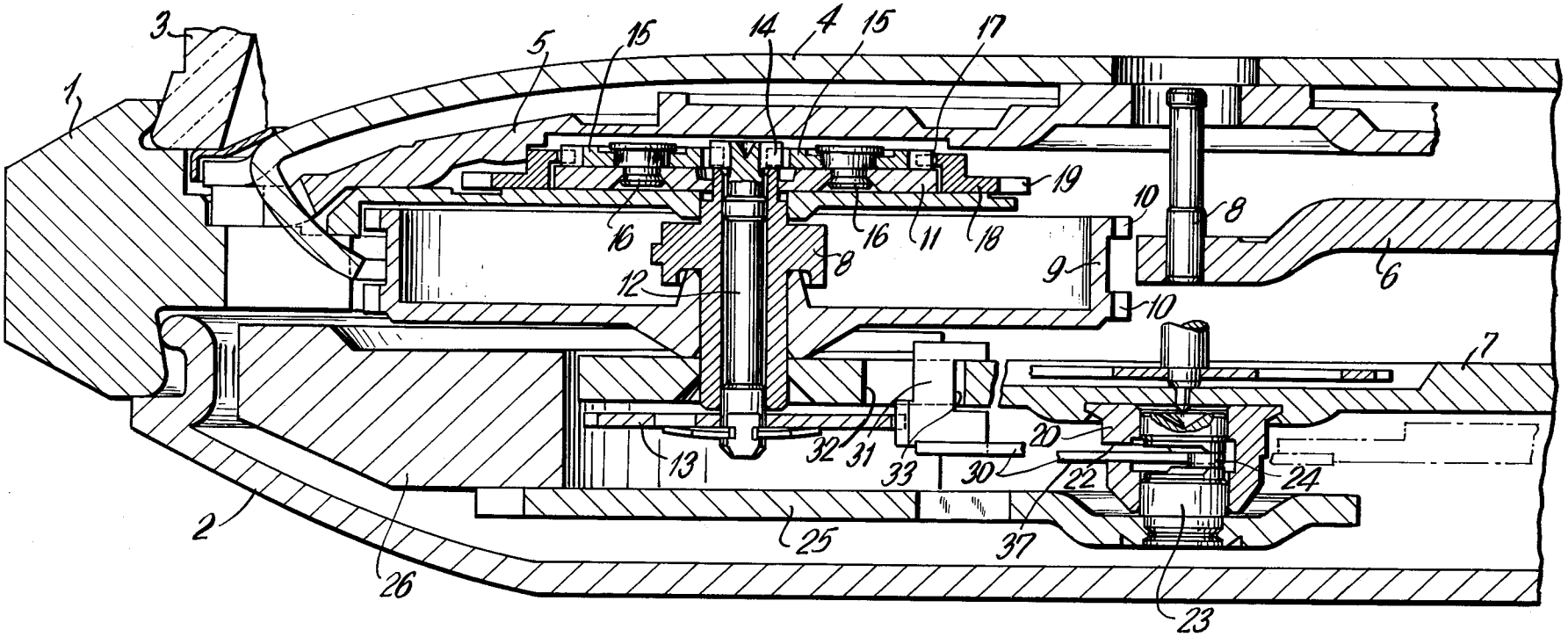

Referring now to FIG. 1 of the drawing, a sectional elevation view of portions of a wristwatch is shown which omits the conventional portions of the watch for clarity and shows only the automatic winding mechanism elements which are material to the present invention. The main structural members of the watch include the case 1, removeable caseback 2, transparent crystal 3, dial 4, front frame plate 5, bridge 6, and a back frame support member 7. The frames and bridge 5, 6, and 7 support the conventional time gear train (not shown) including the various staffs such as the sweep second hand staff indicated at 8.

The conventional portions of the watch also include a mainspring and planetary redution gearing for multiplying force of the self-wind mechanism to keep the mainspring wound. Various types of reduction gearing devices are known in the art for permitting winding of the mainspring by repetitively and frequently rotating a pinion shaft with rather weak movements of the automatic and manual winding of the mainspring. One such device consists of two one-way clutches, each of which drives a gear connected to the arbor of the watch mainspring and a reduction gear train for the automatic winding mechanism. Another such device, shown in the preferred embodiment of the present invention but not limited thereto, is a planetary gear reduction device more particularly described in the aforementioned U.S. Pat. No.3,104,517 which is incorporated herein by reference.

The planetary gear system utilizes a hollow arbor 8 attached to the mainspring of the watch (not shown). The controlled unwinding of the mainspring rotates a barrel 9 to power the time gear train of a conventional watch movement via external teeth 10. A planet pinion plate 11 is attached to the top of arbor 8. A pinion shaft 12 passes through the arbor 8 and is attached at its bottom end to a ratchet wheel 13. A sun gear pinion is attached to the top end of pinion shaft 12. A pair of oppositely disposed planet pinions 15 are rotatably mounted on shafts 16 which allow the planet gears 15 to rotate freely and mesh with the sun pinion 14. The planets in turn mesh with internal teeth 17 on a ring gear 18. External teeth 19 on the ring gear may be rotated for manual winding or held fast when the planetary system is functioning as reduction gearing, by means of additional devices (not shown here but clearly described in the aforementioned U.S. Pat. No. 3,104,517). Unidirectional rotation of the ratchet wheel 13 and pinion shaft 12 with rather weak forces serves to keep the watch mainspring wound.

Now turning to the novel features of the present invention, the watch back frame member 7 carries a fixed rotor bushing 20 on the side of the back frame projecting toward the watch caseback 2 so that the bushing is exposed when the caseback is removed. The bushing includes a cylindrical bore 21 having a slot 22 intersecting the bore. Rotatably disposed in the bore is a rotor staff 23 having an eccentric crank portion 24 aligned with the slot. The rotor consists of a rotor plate 25 with an eccentric off-center mass 26. The rotor is attached to the rotor staff 23 so that it is rotatably mounted in the bushing.

An integral rocking arm, portions of which are shown at 30, is operatively connected between ratchet wheel 13 and the eccentric crank portion 24 of the rotor staff. The construction of the rocker arm 30 will be explained in detail in connection with discussion of FIGS. 3-5. However in FIG. 1, it will be seen that the rocker arm 30 includes an upstanding portion 31 extending through a keyhole slot 32 in the backframe with a cutout section 33 of slightly greater width than the backframe thickness so as to support the rocking arm 30 from the backframe and to permit limited movement for operation of the ratchet wheel.

Figure 2:
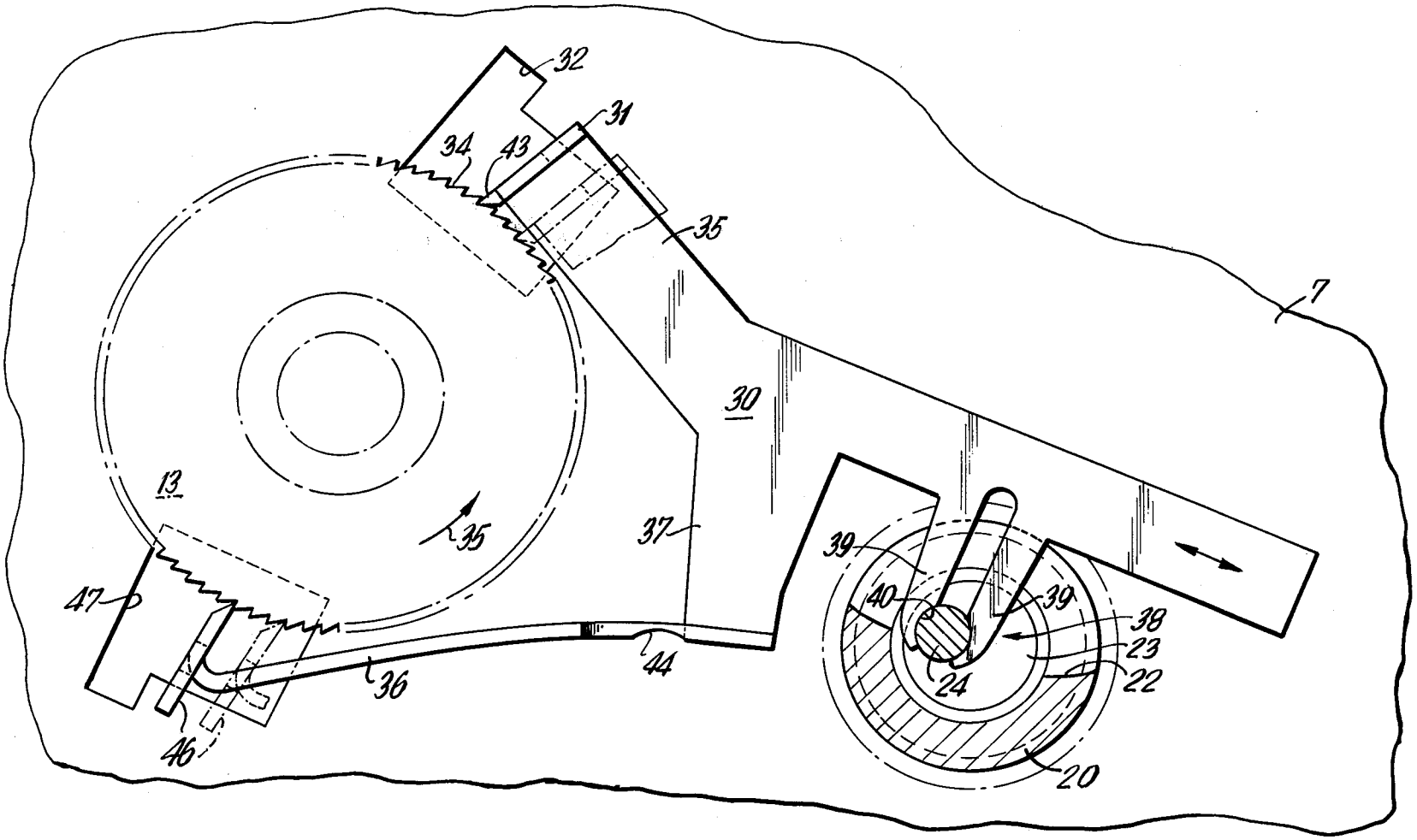

Referring now to the plan view of FIG. 2, only the motion conversion device comprising ratchet wheel 13, rocking arm 30, and rotor staff and crank 23, 24 are shown. The ratchet wheel 13 has teeth 34 slanted to impart unidirectional rotation in the direction of the arrow 35 when actuated by reciprocating motion of rocker arm 30. The rocker 30 from a single metal stamping has a first click arm 35 and a second click arm 36 bent upward at right angles to the first click arm from a connecting portion 37. The first click arm 35 has a upstanding tab 31 forming a first pawl acting with the ratchet wheel teeth, and the second arm 36 terminates in a tab 38 forming a second pawl diametrically opposite the first pawl on ratchet wheel 13.

On the other end of the rocking arm, a spring clip shown generally as 38 is formed by means of two fingers 39 having arcuate portions 40 arranged to snap on to the eccentric crank portion 24 of the rotor staff. As can be seen by reference to FIGS. 1 and 2, fingers 38 extend through the slot 22 in the staff bushing and the fingers thereby serve to hold the rotor and rotor staff in the bushing as well as to limit axial outward movement of the rotor staff in the bushing.

Figure 3:
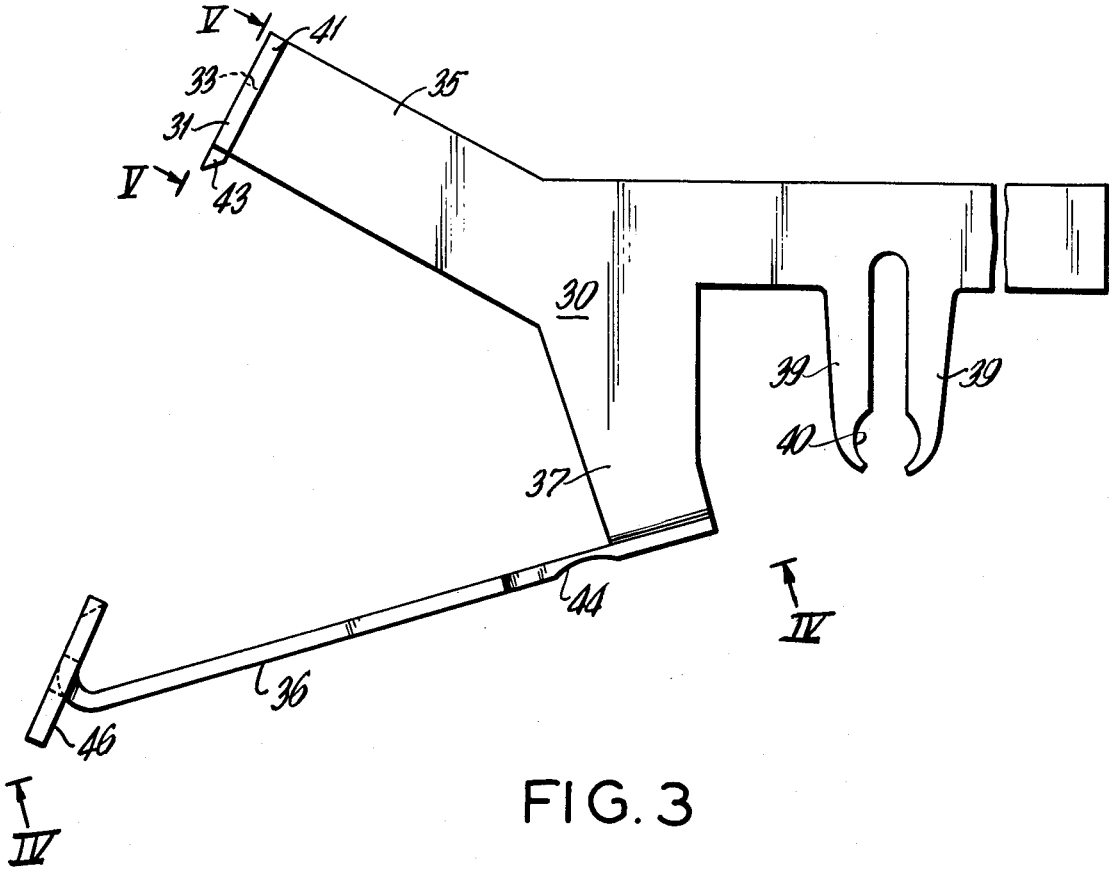
Figure 4:
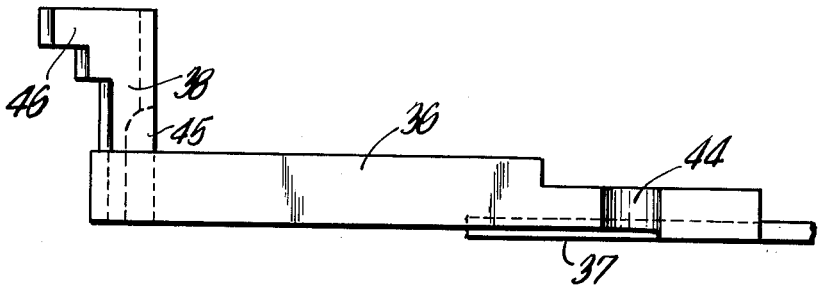
Figure 5:
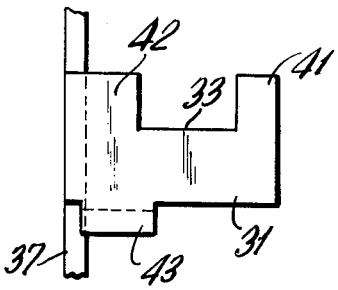

The first and second click arms of the rocking arm are spring loaded against opposite sides of the ratchet wheel 13. While FIG. 2 shows the rocker arm in operative position with the second spring arm 36 bent in a flexed position, FIGS. 3, 4, and 5 illustrate the rocking arm details prior to assembly. The tab 31 on the first click arm includes the aforementioned recess 33 so as to provide upper and lower tabs 41, 42 respectively to hold the arm supported from the backframe. The outer side of extension 31 has a bevelled pawl section 43 which cooperates with the ratchet teeth.

The second click arm 36 (shown straight in FIG. 3) is flat, disposed at right angles to the rocker arm proper so as to be at right angles to the plane of the ratchet wheel. Also it is provided with a reduced cross-section at 44 to increase flexibility. The aforementioned extension 38 on the end of the click arm 36 includes a bevelled pawl portion 45 engaging the ratchet wheel teeth and a tab 46 for holding the end of the click arm suspended from the back frame is a keyhole slot 47 (FIG. 2).

OPERATION

Reference to FIG. 2 illustrates the operation of the improved motion conversion device. Movement of the wristwatch causes periodic, non-uniform oscillation of the eccentric crank portion 24 causing reciprocating rocking arm motion toward and away from the ratchet wheel 13. Motion toward the ratchet wheel causes the pawl on the first click arm 35 to engage and the pawl on the second click arm to ride over the teeth. Motion in the opposite direction causes the pawl on the second click arm to engage and the pawl on the first click arm to ride over the teeth. Both of these motions to and fro cause rotation of the ratchet wheel in the direction of arrow 35. The flexibility of the second spring loaded click arm 36 keeps the click arm pawls engaged with the ratchet teeth at all times.

To assemble the rocker arm it is only necessary to insert the tabs on the pawl ends of the click arms in the enlarged portions of the keyhole slots, pull the rocker arm toward the rotor staff, and to then engage the spring clip through slot 22 around the eccentric crank 24 from the side thereof. Therefore the spring clip serves to retain the rotor in the bushing. Thereby a very simple and reliable automatic winding mechanism is provided which uses a minimum of parts and which can be easily disassembld for servicing.

While there has been shown what has been considered to be the preferred embodiment of the invention, it is understood that various other modifications may be made therein and it is intended to cover in the appended claims all such modifications as fall within the true spirit and scope of the invention.

I claim:

1. In a watch including a mainspring driving a time gear train and having reduction gearing for winding the mainspring by unidirectional rotation of a winding pinion, the improvement comprising:

a supporting frame member inside the watch, a ratchet wheel rotatably mounted on said frame member and operatively connected to drive said winding pinion, a rotor bushing projecting from said frame member, said bushing having a cylindrical bore, a rotor staff journaled in said bushing and having an eccentric crank portion, a rotor attached to said rotor staff and having an off-center mass which causes angular oscillation when the rotor is reoriented by movement of the watch, and a single piece rocking arm having first and second spring loaded click arms having pawl portions cooperating with opposite sides of said ratchet wheel, and having integral spring clip fingers adapted to snap onto said eccentric crank portion from the side thereof, whereby priodic oscillation of the rotor staff crank causes said click arms to rotate the ratchet wheel and wind the mainspring of the watch.

2. The combination according to claim 1, wherein said rocking arm is formed from a single stamping and at least one of said click arms is flat and disposed at right angles to the plane of the ratchet wheel to provide flexibility of said click arm.

3. The combination according to claim 2, wherein said so disposed click arm also has a reduced cross-sectional area at one portion thereof to provide additional flexibility.

4. The combination according to claim 1, wherein both of the pawl portions of said click arms further include locking tabs adapted to support the click arms of the rocking arm from said frame support member.

5. The combination according to claim 1, wherein said rotor bushing includes a slot intersecting said cylindrical bore and wherein the eccentric crank portion of the rotor staff is aligned with said slot, and wherein said spring clip comprises a pair of fingers extending through said slot and having arcuate portions adapted to grip said crank portion.

6. The combination according to claim 1, wherein said rocking arm comprises a metal stamping having a first click arm with a terminating end portion bent at right angles and forming locking tabs to support the rocking arm from the frame and also having a bevelled pawl portion engaging the ratchet teeth, a second click arm disposed at right angles to the first click arm and having a terminating end portion providing locking tabs for holding the click arm in the housing and a bevelled pawl portion engaging the ratchet teeth, and said rocking arm also having first and second fingers forming the rocking arm spring clip, said fingers having arcuate ends thereon adpated to grip the eccentric crank portion of the rotor staff.

7. In a watch including a mainspring driving a time gear train and having reduction gearing for winding the mainspring by unidirectional rotation of a winding pinion, the improvement comprising:

a supporting member inside the watch a ratchet wheel rotatably mounted on said frame member operatively connected to drive said winding pinion and having ratchet teeth a rotor bushing projecting from the said frame member having a cylindrical bore and a slot intersecting the bore, a rotor staff journaled in said bore and having an eccentric crank portion aligned with the slot, a rotor connected to said rotor staff and having an off-center mass causing angular oscillation when the rotor is reoriented by movement of the watch, and a single piece rocking arm formed from a single metal stamping and having first and second click arms, at least one of which is disposed at right angles to the plane of the ratchet wheel, each of said click arms having terminating end portions with bevelled pawl portions spring loaded by the click arms to engage the ratchet teeth and also having locking tabs supporting the rocking arm from the frame member, said rocking arm further having a spring clip comprising a pair of fingers disposed within the rotor bushing slot and having arcuate portions engaging said eccentric crank portion of the rotor staff to retain the rotor within the bushing, whereby oscillation of the rotor causes the rocking arm to impart unidirectional rotation to said ratchet wheel.

* * * * *